United States Patent [19]

Klunk et al.

[11] Patent Number: 4,895,534

[45] Date of Patent: Jan. 23, 1990

[54] PULL TO SEAT CONNECTOR

[75] Inventors: Thomas M. Klunk, Dover, Pa.; Allen F. VanDerStuyf, Kernersville, N.C.

[73] Assignee: AMP Incorporated, Harrisburg, Pa.

[21] Appl. No.: 333,847

[22] Filed: Apr. 3, 1989

Related U.S. Application Data

[63] Continuation of Ser. No. 130,761, Dec. 9, 1987, abandoned.

[51] Int. Cl.[4] ..... H01R 13/40

[52] U.S. Cl. ..... 439/599

[58] Field of Search ..... 439/594, 597, 599–601, 439/603

[56] References Cited

U.S. PATENT DOCUMENTS

| | | | |
|---|---|---|---|
| 3,667,101 | 6/1972 | Kloth | 339/28 |
| 3,769,701 | 11/1973 | Kloth | 29/264 |
| 4,147,400 | 4/1979 | Snyder, Jr. et al. | 339/217 S |
| 4,346,959 | 8/1982 | Daugherty et al. | 339/217 S |
| 4,557,542 | 12/1985 | Coller et al. | 339/59 M |
| 4,588,242 | 5/1986 | McDowell et al. | 339/59 M |
| 4,772,231 | 9/1988 | Hayes | 439/752 |

FOREIGN PATENT DOCUMENTS 2437706 9/1979 France .

*Primary Examiner*—P. Austin Bradley

*Attorney, Agent, or Firm*—Robert W. Pitts

[57] ABSTRACT

A pull to seat electrical connector having a plurality of terminals which are pulled into cavities in an insulative housing through the mating face of the terminal is disclosed. Unterminated wires are first inserted through cavities in the housing and terminals are attached adjacent the housing mating face. When wires are then pulled, the terminals are pulled into the cavities and rotated into alignment with the cavities, so that box-shaped receptacle contact sections are properly oriented. The rear of each cavity conforms generally to the outer contour of the wires, whereas the receptacle enclosing portion of each cavity adjacent the mating face of the connector conforms generally to the receptacle configuration, such as a box-shaped receptacle contact portion. Stop fingers, extending upwardly from the terminal, engage inner shoulders to stop rearward movement of the terminals in the cavities. A retainer cap, formed of a material more flexible than the main housing, is then snapped onto the connector and attached to the mating face to prevent the terminals from being pushed out through the mating face.

21 Claims, 7 Drawing Sheets

PULL TO SEAT CONNECTOR

This application is a continuation of applicaton Ser. No. 130,761 filed Dec. 9, 1987, now abandoned.

BACKGROUND OF THE INVENTION

1. Field of the Invention

This invention relates to an electrical connector of the type having an insulating material forming an insulative housing enclosing both an electrical terminal and a portion of the conductor, such as a wire, to which the terminal is attached. More particularly, this invention relates to an electrical connector having means for retaining the terminal in the housing. Specifically, this invention relates to an electrical connector in which the conductor is first inserted through the insulative housing and the terminal is crimped to the terminal on one side of the housing after which the terminal is then pulled back into a cavity within the insulative housing.

2. Description of the Prior Art

One common cause of unsatisfactory electrical connections in harnesses or devices employing a plurality of terminals within individual insulative housings arises from the difficulty of retaining or securing terminals in position within the housing. These problems are especially aggravated because the failure of one out of a number of terminals in a single multicontact housing or in a harness containing a plurality of multicontact terminals has proven difficult to avoid. Thus, although numerous connectors have been devised having generally satisfactory terminal retention configurations, most connectors are still subject to the occasional failure. These failure can be especially troublesome to locate and to repair. The difficulty of assuring proper terminal retention within multicontact housing is aggravated when the connector is used in an environment in which it is subject to vibration. Thus, although the terminal may initially be properly positioned within the housing, vibration may result in disengagement of the terminal over time. These problems are especially significant in automotive wiring harnesses.

A number of configurations have been employed in an attempt to alleviate these problems. One such electrical connector which has exhibited generally satisfactory performance is that disclosed in U.S. Pat. No. 4,557,542. This connector employs a plurality of flexible latch arms having distal ends formed to engage surfaces on terminals inserted in the housing cavities. When crimp snap connectors of the type shown in this patent are inserted from the rear or wire receiving end of the housing, the resilient latch arms initially are cammed to flex outwardly to permit full insertion of the crimp snap terminals into the housing cavities. Upon complete insertion of the terminals into the cavities, the flexible latch arms snap back into position to engage appropriate stop surfaces on the terminal. This particular device employs a separate wedge bar which can be inserted from the front or mating surface adjacent the receptacle portion of the terminals. This wedge bar engages the flexible latch retaining arms in the housing to ensure that the wedge bar remains in its fully deflected position. These wedge bars serve to provide terminal position assurance since the wedge bars cannot be fully inserted into engagement with the flexible latch arms unless the terminals themselves are properly inserted.

One significant disadvantage of electrical connectors constructed in this manner is that the principal electrical housing must be formed of a material sufficiently resilient to permit the latch arms to flex during terminal insertion. These latch arms also constitute complex structures making the housing more difficult and expensive to manufacture.

The disadvantages of employing resilient latching housing members such as that shown in U.S. Pat. No. 4,557,542 with crimp snap terminals inserted from the rear of the housing have generally been outweighed by the terminal application disadvantages. With a rear entry crimp snap configuration, as represented by U.S. Pat. No. 4,557,542, individual terminals may be attached to individual wires prior to assembly within a housing. Terminal application equipment suitable for performing this function in a rapid automated manner is generally available.

An alternative to the crimp snap rear entry configuration represented by U.S. Pat. No. 4,557,542 is the insertion of conductors through a terminal housing prior to the attachment of the terminals to the ends of the conductors. After the terminals are attached, the terminals can then be pulled to seat by pulling the wires, causing the terminals to enter the insulative housings from the front mating face. U.S. Pat. No. 3,667,101 discloses a pull to seat configuration in which stamped and formed pin and socket terminals are pulled to seat within a housing. The socket contacts depicted in that patent, like mating pin, contacts, are cylindrical in configuration so that orientation of the individual terminals within a housing is not required. Securement of the terminals in the housing is achieved by engagement of protruding rearwardly directed retaining lances which engage shoulders within the insulating housing. Protruding stabilizing dimples and lances are used to stabilize these terminals within the housing.

Pin and socket terminals such as those used in the configuration of U.S. Pat. No. 3,667,101 are in many cases, inappropriate for the interconnection desired for a particular application. Many automotive connectors employ tab and receptacle terminals which, unlike pin and socket terminals, must be properly oriented within the housing. U.S. Pat. No. 4,346,959 discloses a tab and receptacle configuration. That pull to seat connector is intended for use with terminals which are applied to the conductors prior to assembly in the housing. The conductors are inserted into slots on the outer side of the terminal housings and the terminals are then pulled into cavities communicating with the exterior slots. To ensure alignment of receptacle terminals, that patent employs a protruding tab which is received within the exterior slot in the housing. Another tab and receptacle pull to seat connector is shown in U.S. Pat. No. 4,588,242. That patent, too, has exterior slots in the housing which define resilient latching fingers on the exterior of the housing. These resilient latching fingers are cammed out of the way when the terminals are pulled into the connector.

These prior art, pull to seat connectors, however, generally employ either resilient lances for securing, aligning or stabilizing the terminals, or the cavities of the connector housing are not closed on all sides. Protruding lances on crimp snap terminals can result in entanglement of the conductors prior to installation in a housing and resilient protruding lances, such as those normally used with crimp snap connectors, can be bent so that they do not function properly upon insertion into the housing. Resilient fingers on connector housings not only complicate the molding of the housing but, especially for small connectors, are subject to damage when handled. Connectors in which the terminals are exposed along the sides of the connector housing have not found significant acceptance and can be subject to shorting or contamination, since the terminal is not protected by a fully enclosed housing. The instant invention avoids these problems by using a pull to seat approach in which the main housing body is formed of a one-piece rigid housing which does not employ any flexible terminal securing members, either in the housing or on the terminal.

SUMMARY OF THE INVENTION

The pull to seat connector depicted herein comprises a generally rigid, relatively inflexible housing which does not have flexible or deflectable terminal retaining fingers. The terminals also do not employ resilient or deflectable retaining lances or fingers. The connector comprises a pull to seat connector in which terminals are crimped or conventionally attached to individual conductors after the conductors have been inserted into the housing. The terminals are attached to the conductors on the forward or mating end of the housing. When the conductors are pulled, the terminals are drawn into fully enclosed cavities within the housing through the mating face of the connector. A diverging aligning segment on each terminal ensures that the terminals are rotated into alignment for proper positioning within the housing as the terminals are pulled into the housing. Stationary stop ears or fingers, located on the terminal, engage an internal shoulder in the housing to prevent further rearward movement of the contact. A separate retainer cap can then be attached at the mating face of the connector to prevent forward movement of the terminal. Since the retainer cap is a separate member, it can be formed of a more flexible material, permitting the retainer cap to be flexed when attached to the more rigid terminal housing.

BRIEF DESCRIPTION OF THE DRAWINGS

FIG. 2 is a view similar to FIG. 1, partially in section, showing the manner in which the terminals are pulled to seat in the housing.

FIGS. 3, 4 and 5 are sections taken respectively along section lines 3—3, 4—4 and 5—5 of FIG. 2. These section views show the configuration of three portions of each cavity in the housing.

FIG. 8 shows the rotational movement of the terminal as it engages the housing adjacent the mating face of the housing.

FIG. 9 is a section view taken along section lines 9—9 of FIG. 8 demonstrating the engagement of the diverging camming segment of the terminal with the cavity walls, which imparts rotation to the terminals.

FIG. 12 is a sectional view showing assembly of the connector with a mating electrical connector.

FIG. 13 is a view demonstrating the manner in which the retainer cap flexes to permit attachment to the mating face of the connector.

FIG. 14 is a fragmentary view showing the tapered or diverging camming segment of each terminal.

DETAILED DESCRIPTION OF THE PREFERRED EMBODIMENT

Figure 1:
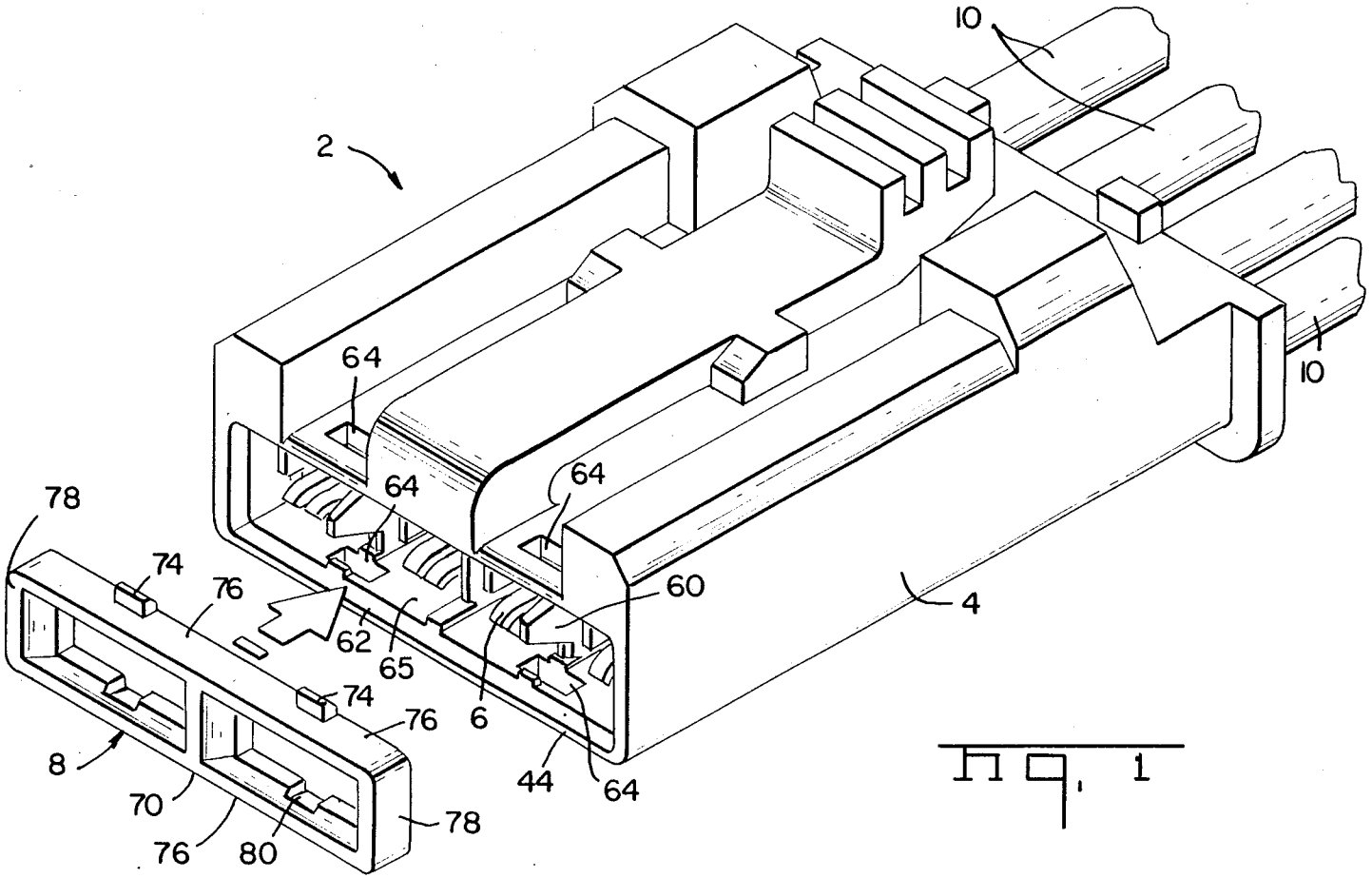
FIG. 1 is a partially exploded perspective view of the connector.

The electrical connector 2 comprising the preferred embodiment of this invention comprises a rigid relatively inflexible one-piece insulative housing 4, a plurality of stamped and formed terminals 6, and a relatively flexible retainer cap 8 which can be attached to the mating face of the connector housing 4. Each terminal 6 can be crimped to a conductor or wire 10. Terminals 6 each include a crimping section 16 and a non-circular or box-shaped receptacle contact section 20. The crimping section 16 is located adjacent a first terminal end 12. In the preferred embodiment of this invention, the terminal further includes an insulation crimp 18 located between the wire crimping section 16 and the first terminal end 12. The receptacle contact 20 is located adjacent a second terminal end 14 and has a generally rectangular configuration. The insulation crimp 18 conforms closely to the circular contour of each wire 10 while the crimping section 16 does not significantly protrude from the envelop formed by the circular projection of the periphery of the individual wires 10. The box-shaped receptacle contact 20, however, has at least one dimension which is significantly greater than the outer diameter of the insulated wires 10.

The receptacle contact 20 is of the type suited to engage a planar tab 88 in a complementary terminal 86. Box-shaped receptacle contact section 20 includes a base 22, an outer cantilever contact 24 on the opposite side of the box-shaped receptacle section from base 22, and a pair of side walls 26 extending between base 22 and the outer cantilever contact 24 along the sides of the rectangular envelope of the receptacle contact 20. A cantilever spring 28 extends from the forward edge of receptacle base 22 and is disposed in opposed relationship to the outer cantilever contact 24. Cantilever spring 28 and the outer cantilever contacts 24 thus form a contact point to engage a tab 88 upon insertion into the receptacle contact. A lance 30 is struck inwardly from the receptacle contact base at a position spaced from the forward edge of base 22. This overstress lance engages the cantilever spring to add additional force to the interface. In the preferred embodiment of this invention, the outer cantilever contact 24 is bifurcated, and each leg has an outwardly radiused nose 25 at its forward end opposite the intersection between the cantilever spring 28 and the base 22.

A transition section is located intermediate the generally circular crimp sections 16, 18 and the box-shaped or generally rectangular receptacle contact section 20. This transition section forms a tapered segment diverging from the center of the contact terminal toward the receptacle contact section. This tapered or camming segment 34 extends from a generally semi-circular cross-section adjacent the wire crimping section 16 to a generally rectangular cross-section having one open face adjacent the receptacle contact section 20. Plural camming surfaces 36, which constitute the fold line between the base of the transition section and its side walls, are formed. Two spaced apart stop fingers 32 extend upwardly from the lower base of the transition segment 34. Stop fingers 32 are essentially parallel and are formed generally in the plane of the receptacle contact side walls 26. In the preferred embodiment of this invention, the stop fingers 32 are not intended to deflect. These stop fingers 32 are located at the widest end of the tapered or diverging camming segment and have a height at least equal to the height of the box-shaped receptacle contact section 20. As will be apparent, the height and the side-to-side spacing of the stop fingers are such that the stop fingers 32 will conform to the interior contour of at least a portion of cavities in the insulative housing 4.

Figures 2, 4, 5:
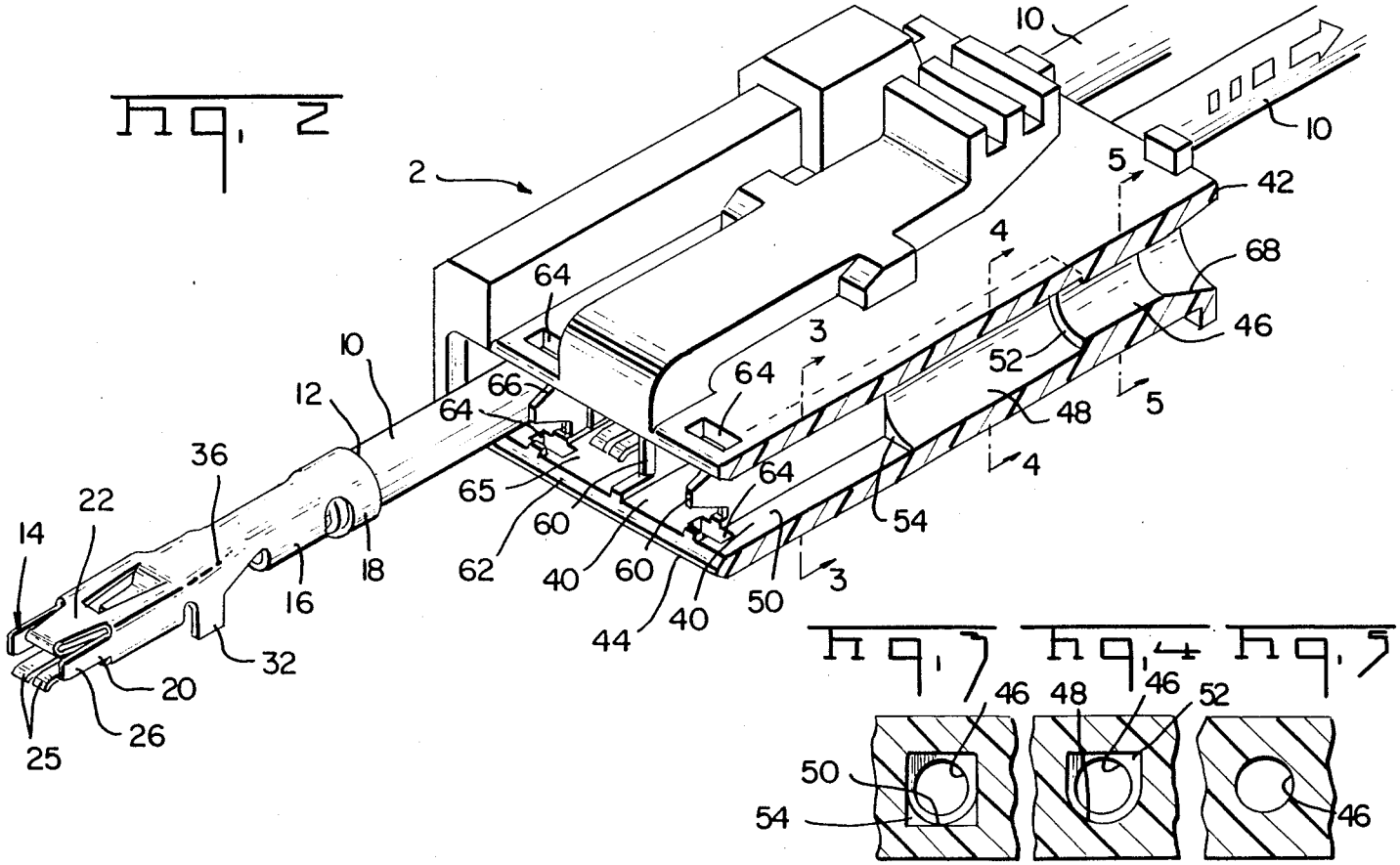
Figure 6:
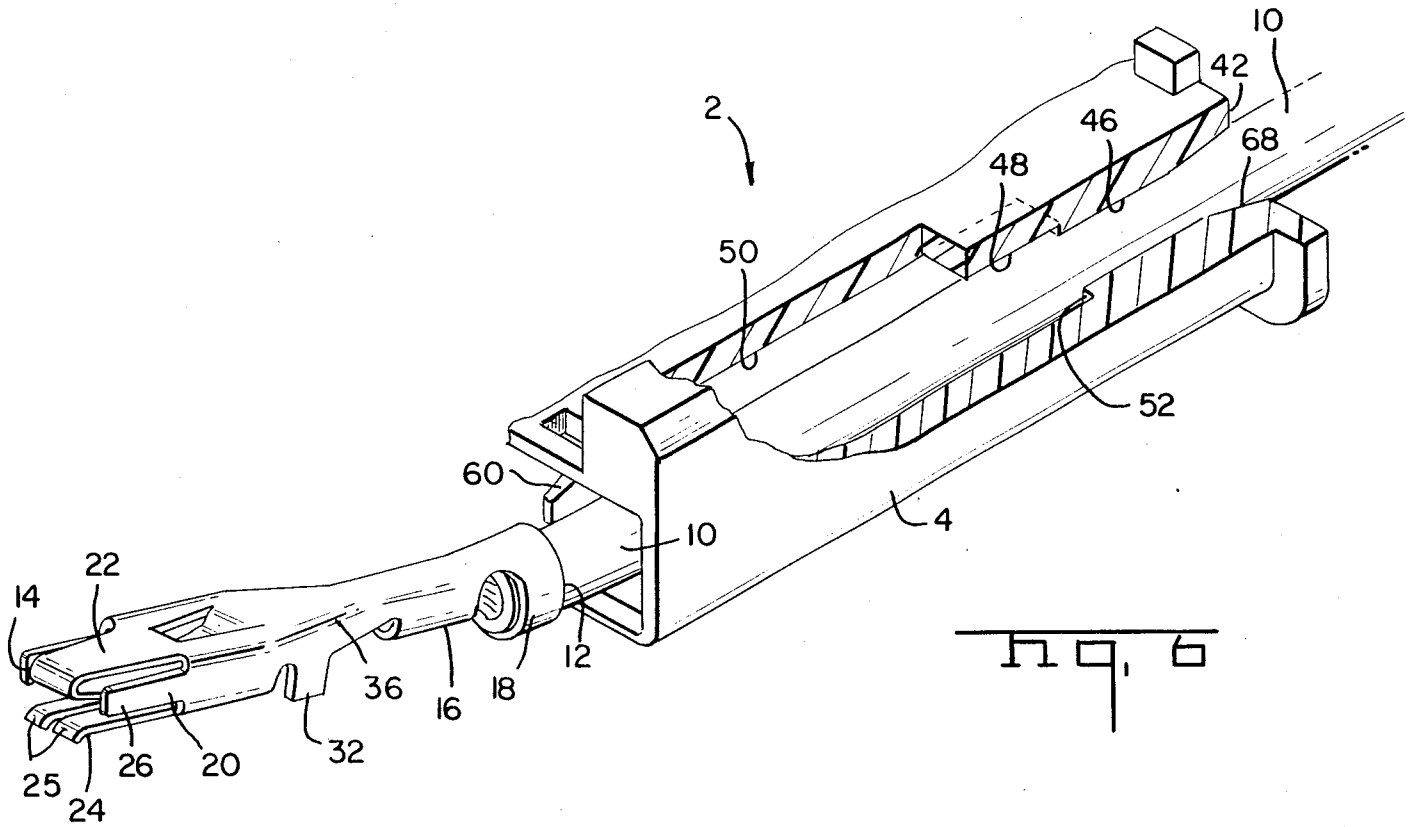
FIG. 6 is a view illustrating the misalignment of a terminal which can be expected as the terminal is pulled from the forward end of the connector.

The insulative housing 4 is formed of a relatively rigid material such as thirty percent glass filled Poly Butylene Terepthalate. The housing 4 has a plurality of side-by-side housing cavities 40 extending from a housing wire receiving end 42 to an opposite housing contact receiving end 44. The preferred embodiment of this invention depicts a four cavity housing. Each housing cavity consists of three portions. A wire enclosing portion 46 having a generally circular cross-section conforming to the exterior of wires 10 is located adjacent the housing wire receiving end 42. A crimp enclosing portion 48, wider than the wire enclosing portion 46, is located adjacent to the wire enclosing portion and is intermediate the ends of the housing cavities 40. A receptacle enclosing portion 50 having a generally rectangular cross-section is located adjacent to the contact receiving end 44. The intermediate crimp enclosing portion 48 has a D-shaped cross-section formed by a cylindrical face 56 and an opposite rectangular face 58. A first shoulder 52 is formed at the transition between the circular cross-section of the wire enclosing portion 46 and the D-shaped contour of the crimp enclosing portion 48. This shoulder 52 is best seen in FIG. 4.

A second shoulder 54 is formed at the transition between the circular or cylindrical face 56 of the crimp enclosing portion 48 and the generally rectangular cross-section of the receptacle enclosing portion 50. This second shoulder 54 is best seen in FIG. 3. Shoulders 54 comprise a pair of shoulders each having the shape of an elliptical quadrant formed by a cylindrical surface and the corner of a generally rectangular surface. In the preferred embodiment of this invention, these elliptical quadrants are indeed formed by a right circular cylindrical surface and a rectangular surface.

Adjacent interior cavities 40 are separated by walls 60. At least one or more of these walls does not extend completely to the mating face of the connector. A truncated tapered wall extension 66 is defined on the forward end of at least one of the walls 60. Note, however, that the extension 66 is not defined on each wall 60 and, in the preferred embodiment of this invention, walls 60 having a tapered extension 66 are separated by other walls 60 which do not have a tapered extension. A common cavity mouth 65 is located at the mating face of the connector. The individual cavities 40 each merge with the cavity mouth 65 which has a rectangular cross-section. The forward edge of the cavity mouth 65 immediately adjacent the mating face of the connector has chamfered surfaces 62 formed completely around its exterior. A plurality of locking apertures 64 are defined in the top and bottom of the housing 4. Note that the locking apertures 64 are defined adjacent the cavity wall extensions 66. In order to facilitate insertion of wires from the rear of the housing 4, a funnel shaped wire entry section 68 is defined at the wire receiving end 42 for each cavity 40.

The forward retainer 8 is molded from a conventional plastic material, such as unfilled Poly Butylene Terepthalate, which is generally more flexible than the material from which the main housing 4 is molded. Retainer 8 has a generally rectangular outer frame 70. In the four position connector, a central retainer strut 72 extends from the upper and lower horizontal legs of the retainer (see FIG. 1). A plurality of retainer latches 74 are formed on the exterior of the retainer frame 70. As shown in FIG. 1, the retaner latches 74 are located between the end walls of the retainer and the central retainer and the central retainer strut 72 is greater than the center-to-center spacing of the housing cavities 40. In fact, this distance is approximately twice the center-to-center spacing of the housing cavities. When the retainer is secured to the main housing 4, the truncated wall extension 66 in the main housing 4 will extend at least partially through the rectangular opening formed between the end walls and adjacent retainer struts 72. An inner notch 80 provides clearance for the tapered extension 66. The upper and lower horizontal legs 76 of the retainer cap 8 are each flexible inwardly when the retainer cap 8 is attached to the mating face of the main housing 4. The spacing between the end walls 78 and the retainer strut 76 is sufficient to prevent the upper and lower horizontal legs to be cammed inwardly by engagement between the retainer latches 74 and the chamfered surface 76 on the main housing 4. When the retainer cap 8 is fully inserted into the cavity mouth 65 of the mating face of the connector, the retainer latches 74 are received within locking apertures 64 on the top and bottom of the housing 4. The horizontal legs 76 of the retainer cap 8 will, when fully assembled, overlap the outwardly radiused nose portions 25 of the terminals, thus retaining the terminals in the housing against a force which would otherwise tend to push the terminals out of the front mating face.

FIGS. 6–11 depict the manner in which the terminal can be pulled into a cavity 40 in this pull to seat connector. When wires 10 are pulled to draw the terminals into the housing, the terminals first engage the mating face of each housing 4. In the preferred embodiment of this invention, the terminal at the rear of the insulation crimping section 18 is beveled or chamfered. The insulation crimping section comprises an O-crimp which will conform substantially to the exterior of the round wires 10. The beveled surfaces on the rear terminal end 12 and the chamfered surfaces 62 on the mating face of the housing each serve to minimize the tendency of the terminals to stub upon initial insertion.

Figure 7:
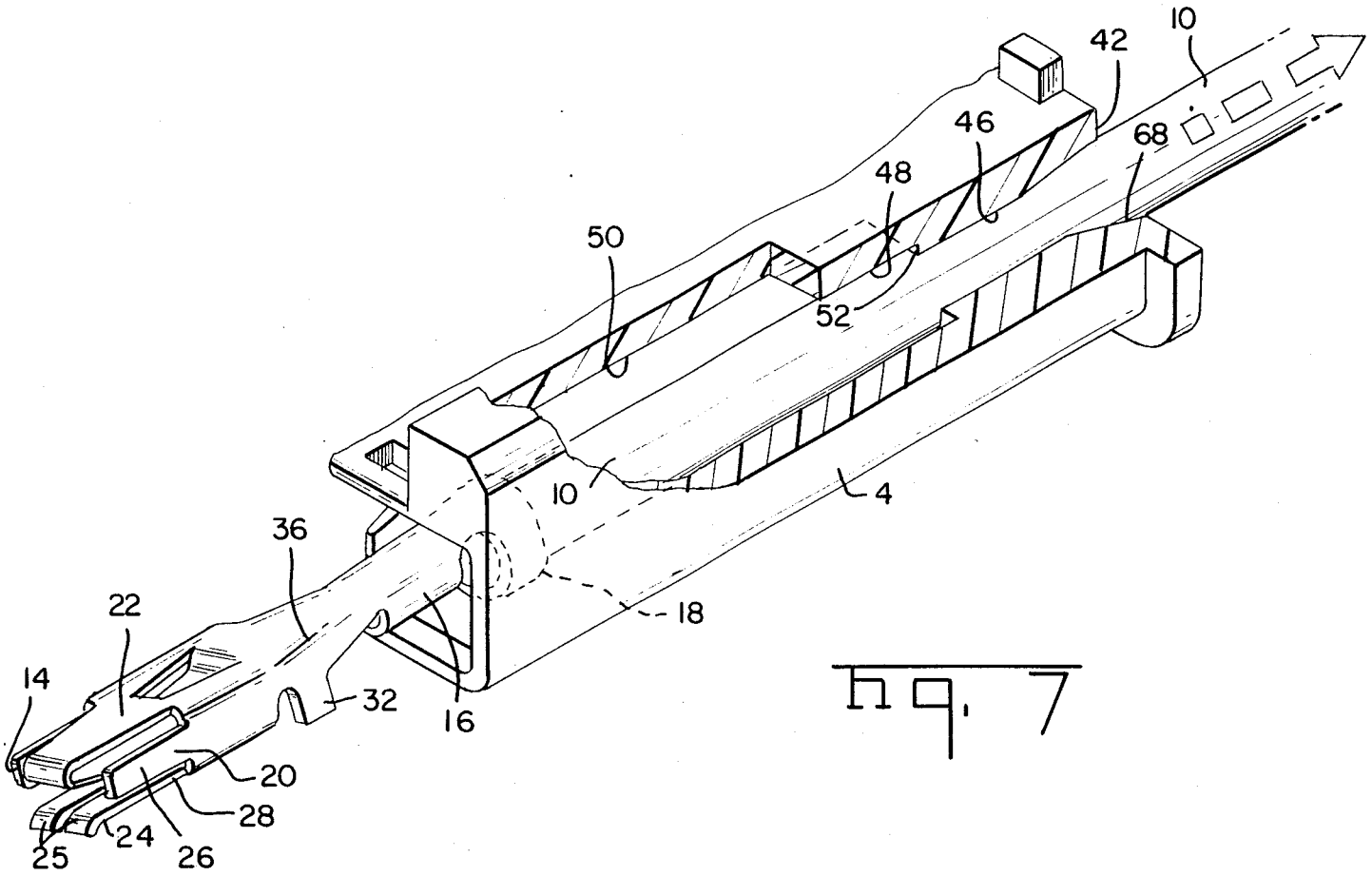
FIG. 7 is a view similar to FIG. 6 showing continued rearward movement of the terminal. Note that the terminal remains rotated and out of orientation relative to the housing cavity.
Figures 1, 7:
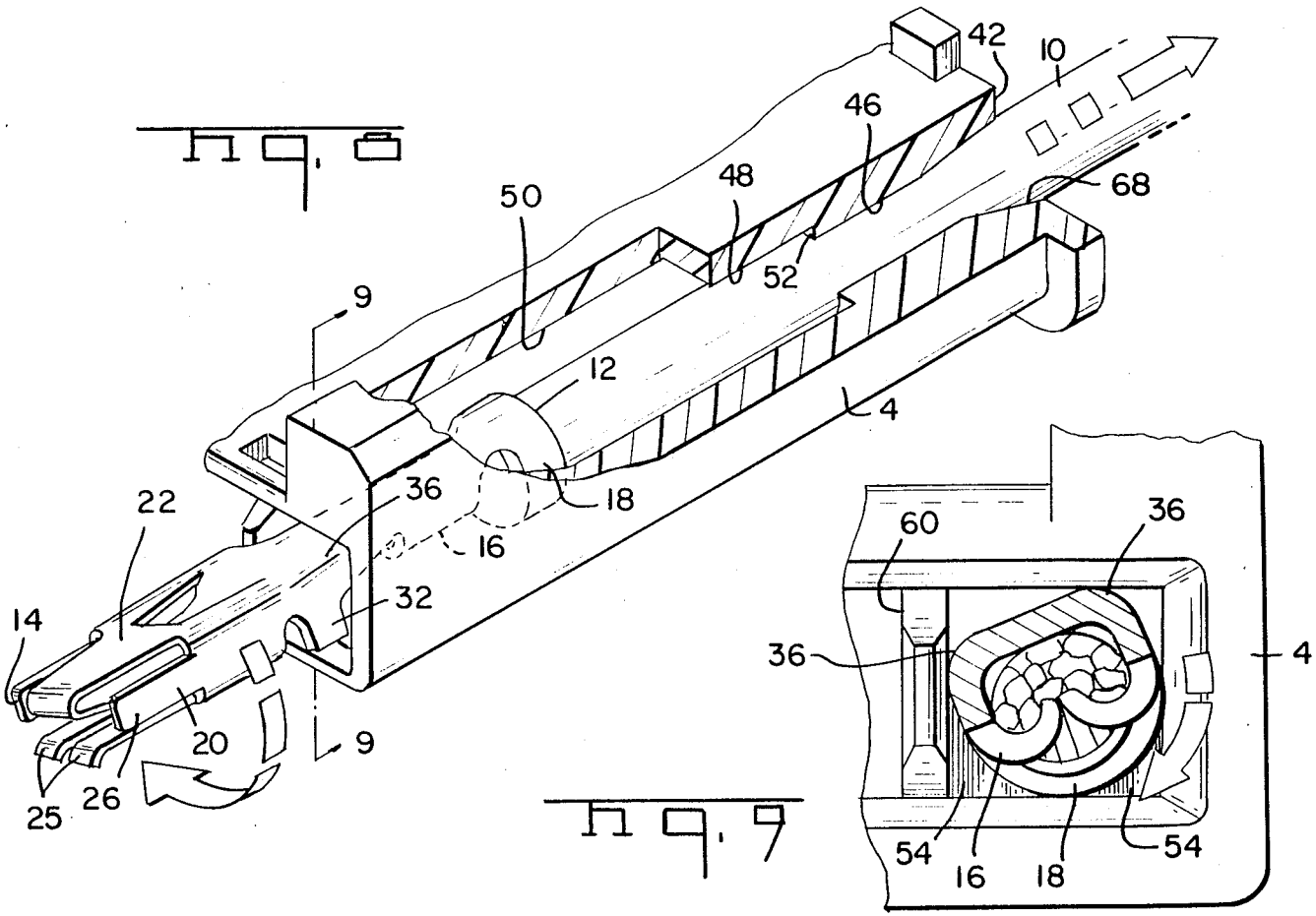

Since the box-shaped receptacle contact section 20 must be oriented with respect to the complementary connector 86 and terminal tab 88, it is necessary to provide some means of properly orienting the box-shaped receptacle contact section 20 in the housing 4. In general, the rotational orientation of the conductor 10 will be insufficient to rotationally orient the receptacle contact section 20. As shown in FIG. 7, movement of the generally circular crimp sections 16, 18 into the rectangular receptacle enclosing portion of the housing will be insufficient to provide proper rotational orientation.

Figure 10:
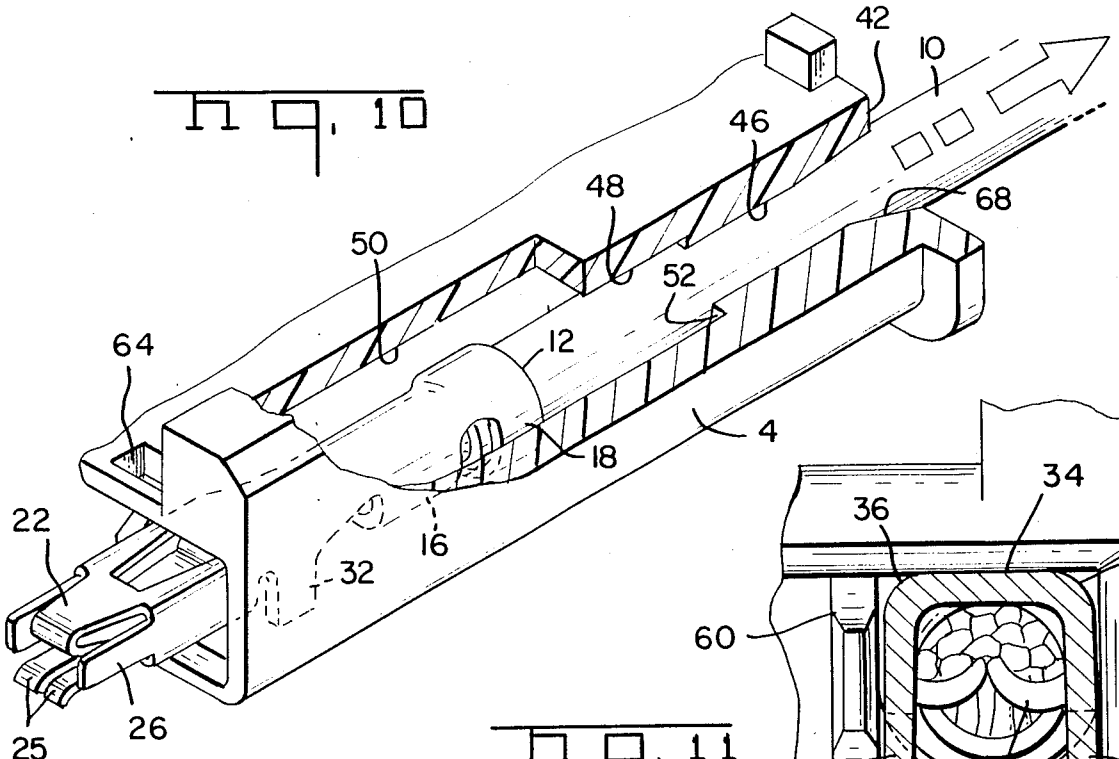
FIG. 10 is a view showing continued rearward movement of the terminal showing the manner in which the stop fingers hold the terminal in proper orientation.
Figure 11:
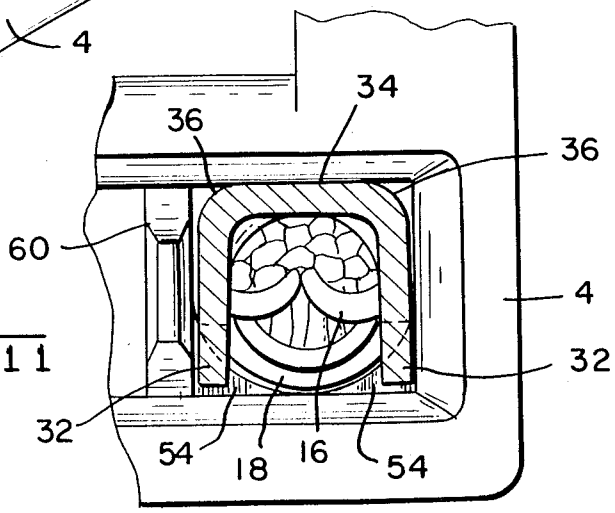
FIG. 11 is a section view along section lines 11—11 shown in FIG. 10, in which the stop means are shown to conform to the interior contour of the receptacle enclosing portion of each cavity.

As shown in FIG. 8, the diverging camming segment 34 will engage the mating face of the housing 4 to rotate and properly orient the terminals before entry of the upstanding stop fingers 32 into the generally rectangular receptacle enclosing portions of the cavities 40. As shown in FIG. 9, the diverging fold lines 36 will engage adjacent side walls in a manner such that the contacts will be cammed into alignment. Note that the terminal also has diverging edges 38 on the same side as the stop fingers 32. These diverging edges will also tend to properly orient the terminals. As shown in FIG. 10, the stop fingers 32 serve to stabilize the terminals once stop fingers 32 enter into the receptacle enclosing portion 50 of each cavity 40. The stop fingers are spaced apart by a distance substantially equal to the width of the receptacle enclosing portion 50 of the cavities 40 and the upstanding stop fingers have a height substantially equal to the height of the receptacle enclosing portion 50 of each cavity 40. Thus, once the terminal is properly oriented by engagement of the diverging camming segment 34 and the exterior of the housing, the terminals will be maintained in their proper position by the stop fingers 32. Movement of the terminals into the housing will bring each of the stop fingers 32 into engagement with one of the stop shoulders 54 defined at the transition between the rectangular receptacle enclosing portion of each cavity and the adjacent D-shaped crimp enclosing portion 48. Fingers 32 serve as the primary stop limiting rearward movement of terminals 6 within the cavities 40. The rear shoulder 52 defined at the intersection of the wire enclosing portion and the crimp enclosing portion 48 will serve as a secondary stop and will engage the rear of the terminals 6 if the outer diameter of the terminals exceeds the inner diameter of the wire enclosing portion 46. The forward stop fingers 32 are a more easily controlled dimension than the diameter of the insulation crimp 18 and, therefore, provide a much more reliable stop means.

After the terminals have been pulled into their respective cavities in the manner depicted herein, the more flexible retainer cap 8 can be attached at the mating face of the connector. Each terminal is now held in position and prevented from moving in either of two longitudinal directions. In this connector, the terminal is held securely in position without relying upon either resilient terminal lances or flexible latching fingers in the housing.

FIG. 12 shows connector 2 mated with a complementary connector 84 having a complementary terminal 86 engaging terminal 6. Terminal 86 has a flat terminal tab for insertion into receptacle contact 20 for engagement by the cantilever spring 28 and the outer cantilever contact 24. The complementary connector 84 is of the type suitable for use with flat flexible circuitry 90. Both the complementary connector 84 and the main connector 2 include outer latch arms 92 and 82, respectively, which engage to hold the two connectors together. The latch 82 on the housing 4 comprises a cantilever member which is deflectable at its free end. Note that the stresses induced in this exterior lance 82, and its size and complexity, do not preclude this outer lance from being formed of the same material and integral with the main housing 4. Latch 82 would be significantly larger than resilient housing retaining fingers that are used on conventional connectors.

The instant invention is not limited to the precise embodiment depicted herein. For example, one of ordinary skill in the art could readily construct a connector employing different crimping sections and difference receptacle contact sections in light of this disclosure of the preferred embodiment of this invention. One skilled in the art could also replace the crimp terminals depicted herein with other conventional means of wire-to-terminal attachment, such as an insulation displacement connector. Such changes would require configurational changes, both to the terminals and to the connector housing, but such changes should be apparent to one of ordinary skill in the art.

We claim:

1. An electrical connector comprising a rigid insulative housing, having a plurality of cavities, and a plurality of stamped and formed terminals, one terminal being received in each cavity, each terminal having a crimping section for engaging a wire adjacent a first terminal end and a noncircular receptacle contact section for engaging a complementary terminal adjacent a second terminal end, wherein:

each housing cavity has a wire enclosing portion adjacent a wire receiving end of the housing, and a receptacle contact enclosing portion adjacent an opposite contact receiving end of the housing, the receptacle contact enclosing portion of each cavity being wider than the wire enclosing portion, a shoulder, facing the contact receiving end, being defined intermediate the wire enclosing portion and the receptacle contact enclosing portion; and each terminal has stop means and a diverging camming segment, the stop means being between the crimping section and the second terminal end, the stop means conforming to the interior contour of the receptacle contact enclosing portion and engaging the shoulder, the camming segment being between the crimping section and the stop means, the camming segment comprising means for engaging the housing adjacent the contact receiving end to orient the stop means to conform to the interior contour of the receptacle contact enclosing portion, whereby a wire can be inserted through each cavity from the wire receiving end beyond the contact receiving end so that each terminal can then be crimped to each wire and each terminal can be pulled into the housing from the contact receiving end, the camming segment engaging the housing to orient the terminal to conform to the contour of each cavity as the terminal is pulled into the cavity.

2. The electrical connector of claim 1 wherein the wire enclosing portion of each cavity has a circular cross-section and the receptacle contact enclosing portion of each cavity has a rectangular cross-section.

3. The electrical connector of claim 1 wherein the shoulder is defined at the transition between a circular cylindrical surface and a larger rectangular surface.

4. The electrical connector of claim 1 further comprising a retainer attachable to the housing at the contact receiving end after the terminals have been positioned in the cavities.

5. The electrical connector of claim 1 wherein the receptacle contact section comprises a box-shaped receptacle contact section.

6. The electrical connector of claim 5 wherein the camming segment is located in a transition section between the crimping section and the receptacle contact section, the camming segment diverging from the center of the terminal toward the receptacle contact section.

7. The electrical connector of claim 6 wherein the transition section comprises a generally tapered segment defining plural camming surfaces.

8. The electrical connector of claim 7 wherein the stop means comprises a pair of opposite fingers extending at the widest end of the tapered segment.

9. The electrical connector of claim 8 wherein the height of the opposite fingers is equal to the height of receptacle contact enclosing portion of each cavity, the opposite fingers being spaced apart by a distance to the width of the receptacle contact enclosing portion of each cavity.

10. The electrical connector of claim 9 wherein the height of the opposite fingers is greater than the height of the box-shaped receptacle contact section.

11. An electrical connector comprising a one piece rigid insulative housing, having a plurality of cavities, and a plurality of terminals, one terminal being received in each cavity, each terminal having a crimping section for engaging a wire adjacent a first terminal end and a box-shaped receptacle contact section for engaging a complementary terminal adjacent a second terminal end, wherein:

each housing cavity has a wire enclosing portion adjacent a wire receiving end of the the housing conforming to the exterior of a wire inserted therein; a receptacle contact enclosing portion adjacent an opposite contact receiving end of the housing; and a crimp enclosing portion between the wire enclosing portion and the receptacle contact enclosing portion, the crimping section of each terminal being received in the crimp enclosing portion; the crimp enclosing portion being wider than the wire enclosing portion and the receptacle contact enclosing portion of each cavity being wider than the crimp enclosing portion, a first shoulder means, facing the contact receiving end, being defined intermediate the wire enclosing portion and the crimping section enclosing portion and a second shoulder means, facing the contact receiving end, being defined between the crimp enclosing portion and the receptacle contact enclosing portion; and each terminal has stop means between the crimping section and the second terminal end, the stop means conforming to the interior contour of the receptacle contact enclosing portion and engaging the second shoulder means, whereby a wire can be inserted through each cavity from the wire receiving end beyond the contact receiving end so that a terminal can be crimped to each wire and the terminal can be pulled into the housing from the contact receiving end.

12. The electrical connector of claim 11 wherein each terminal includes a camming segment between the crimping section and the stop means, the camming segment comprising means for engaging the housing adjacent the contact receiving end to orient the stop means to conform to the interior contour of the receptacle contact enclosing portion as the terminal is pulled into the cavity from the contact receiving end.

13. The electrical connector of claim 11 wherein the receptacle contact enclosing portion has a rectangular cross-section and the crimp enclosing portion has at least one cylindrical face, the second shoulder means being defined in the plane at the intersection of the receptacle contact enclosing portion and the crimp enclosing portion, the second shoulder means comprising a pair of shoulders, each having a cross-section in the shape of an elliptical quadrant.

14. The electrical connector of claim 13 wherein the stop means comprises a pair of fingers on opposite sides of each terminal, each terminal engaging one of the shoulders having a cross-section in the shape of an elliptical quadrant.

15. The electrical connector of claim 11 wherein the crimping section of each termnal is larger than wire enclosing section of each cavity.

16. The electrical connector of claim 15 wherein an end of each terminal adjacent the crimping section is spaced from the first shoulder means when the stop means engages the second shoulder means.

17. An electrical connector comprising a rigid insulative housing, having a plurality of cavities, and a plurality of terminals, one terminal being received in each cavity, each having a crimping section for engaging a wire adjacent a first terminal end and a box-shaped receptacle contact section for engaging a complementary terminal adjacent a second terminal end, wherein:

each housing cavity has a wire enclosing portion adjacent a wire receiving end of the housing, and a receptacle contact enclosing portion having walls defining a rectangular cross-section adjacent an opposite contact receiving end of the housing; and each terminal has a diverging camming segment intermediate the ends, the diverging camming segment comprising means for engaging the walls adjacent the contact receiving end to rotate the box-shaped receptacle contact section into alignment with the interior contour of the receptacle contact enclosing portion, whereby a wire can be inserted through each cavity from the wire receiving end beyond the contact receiving end so that each terminal can then be crimped to each wire and each terminal can be pulled into the housing from the contact receiving end, the diverging camming segment engaging the walls to rotate the terminal into alignment with the rectangular cross-secton of the receptacle contact enclosing portion of each cavity as the terminal is pulled into the cavity.

18. The electrical connector of claim 17 wherein each wall has a chamfered surface at the contact receiving end of the housing, the diverging camming segment engaging the chamfered surfaces of adjacent walls to rotate the box-shaped receptacle contact section into alignment with the receptacle contact enclosing portion of each cavity.

19. An electrical connector comprising a one piece rigid, relatively inflexible insulative housing, having a plurality of cavities, and a plurality of terminals, one terminal being received in each cavity, each terminal having a wire crimping section and a receptacle contact section for engaging a complementary terminal wherein:

each housing cavity extends from a wire receiving end of the housing to an opposite contact receiving end of the housing, each cavity having a larger cross-section adjacent the contact receiving end than adjacent the wire receiving end to define a shoulder in each cavity; and each terminal has stop means abutting the shoulder in each cavity, the connector further comprising a flexible retainer cap engageable with the housing at the contact receiving end, the flexible retainer cap restricting the receptacle contact section of each cavity whereby a wire can be inserted through each cavity from the wire receiving end beyond the contact receiving end so that a terminal can be crimped to each wire and the terminal can be pulled into the housing from the contact receiving end and the flexible retainer cap can be attached to the housing after the terminals are pulled into the cavities.

20. The electrical connector of claim 19 wherein each terminal has an outwardly radiused nose on one side, the retainer cap overlapping the outwardly radiused nose to retain the terminal in the cavities.

21. The electrical connector of claim 19 wherein the housing includes a cantilever latching arm on the exterior, the exterior latching arm being deflectable upon mating with a complementary connector.

* * * * *